US008074816B2

(12) United States Patent
Philippon

(10) Patent No.: US 8,074,816 B2
(45) Date of Patent: Dec. 13, 2011

(54) DEVICE FOR PLACING A TOWER CRANE IN WEATHERVANING MODE

(75) Inventor: Pierre Philippon, Chauffailles (FR)

(73) Assignee: Manitowoc Crane Group France (FR)

( * ) Notice: Subject to any disclaimer, the term of this patent is extended or adjusted under 35 U.S.C. 154(b) by 44 days.

(21) Appl. No.: 12/465,379

(22) Filed: May 13, 2009

(65) Prior Publication Data

US 2009/0308827 A1 Dec. 17, 2009

(30) Foreign Application Priority Data

May 21, 2008 (FR) ..... 08 02757

(51) Int. Cl.
*B66C 23/94* (2006.01)

(52) U.S. Cl. ..... 212/292; 212/247

(58) Field of Classification Search ..... 212/292, 212/247

See application file for complete search history.

(56) References Cited

U.S. PATENT DOCUMENTS

| | | | | |
|---|---|---|---|---|
| 3,763,968 | A * | 10/1973 | Noly | 188/171 |
| 4,588,057 | A * | 5/1986 | Weich et al. | 477/199 |
| 6,010,018 | A * | 1/2000 | Pech | 212/292 |
| 6,772,863 | B2 * | 8/2004 | Jessen et al. | 188/71.5 |
| 7,357,132 | B2 * | 4/2008 | Hayden | 126/604 |

FOREIGN PATENT DOCUMENTS

SU 783205 B * 11/1980

* cited by examiner

*Primary Examiner* — Thomas J Brahan
(74) *Attorney, Agent, or Firm* — Cantor Colburn LLP

(57) ABSTRACT

The crane includes a rotating part composed of a jib and of a counterjib, and a mechanism for slewing the rotating part that has at least one geared motor unit with a motor and reduction gear, and an internal main brake which is deactivated when the crane is placed out of service, in order to allow the rotating part to slew freely according to the direction of the wind. The geared motor unit also includes an internal auxiliary brake which is interposed between the motor and the reduction gear and which is activated when the crane is placed out of service in order to exert on the rotating part a braking torque which avoids uncontrolled rotation of said part when placed in weathervaning mode. The auxiliary brake can be designed to exert an adjustable braking torque.

3 Claims, 3 Drawing Sheets

DEVICE FOR PLACING A TOWER CRANE IN WEATHERVANING MODE

TECHNICAL FIELD OF THE INVENTION

The present invention relates, in a general manner, to the technical field of tower cranes. More particularly, this invention relates to the mechanism for slewing the rotating part of a tower crane, and more precisely still to the device for placing the tower crane in weathervaning mode, which device is associated with the slewing mechanism and which, in the case of the present invention, is aimed at facilitating the weathervaning of the crane in a disturbed wind.

BRIEF DESCRIPTION OF RELATED ART

A tower crane is conventionally composed of two main parts, firstly a nonrotating vertical pylon, also designated as "mast", and secondly a rotating upper part, that is to say capable of slewing about a vertical axis of rotation. The rotating upper part, mounted at the top of the mast, is itself composed of a jib, which extends on one side of the vertical axis of rotation of this rotating part, and of a counterjib which is equipped with a ballast and which extends on the other side of the vertical axis of rotation, thus on the opposite side to the jib. The rotating part is rotated about this vertical axis by means of a motor-driven assembly, designated here as slewing mechanism.

In order to mount the rotating part at the top of the mast of a tower crane, there is usually provided a slewing ring bearing which is interposed between the jib and the counterjib of the rotating part, said bearing being composed of two concentric rings, with one fixed ring connected to the top of the mast and with a movable ring secured to the rotating part, and balls or cylindrical rollers are mounted in a rolling manner between said rings.

In order to rotate the rotating part thus mounted, the slewing mechanism usually comprises at least one electric geared motor unit secured to this rotating part, the geared motor unit rotationally driving a pinion of vertical axis which is engaged with a toothed wheel cut into the fixed ring of the slewing ring bearing. Depending on the mechanical power that needs to be transmitted to set the rotating part in rotation, one, two or more geared reduction units may be mounted on the rotating part. The slewing ring bearing is designed to allow the rotating part to rotate with a minimum drive torque; nevertheless, a torque must be exerted between the parts in question of the crane that is sufficient to overcome the friction of the balls or cylindrical rollers inserted between the fixed ring and the movable ring of the slewing ring bearing.

The slewing geared motor unit usually has an internal brake controlled by an electromagnet. When the geared motor unit is at a standstill, the coil of the electromagnet is not supplied electrically, and a braking torque is exerted. By contrast, when the electromagnet is supplied electrically, no braking torque is exerted by this brake. If there are a plurality of slewing geared motor units, at least one of them is equipped with such a brake, which comes into play during the operating periods of the crane.

Outside these working periods, that is to say when it is "out of service", a tower crane is usually placed in weathervaning mode, that is to say that the rotating part of the crane is allowed to slew freely according to the direction of the wind. The counterjib is thus placed against the wind while the jib is oriented in the direction of the wind, since the area of the jib that is exposed to the wind is greater than that of the counterjib. It may arise that the area of the jib exposed to the wind is increased by, for example, vertical plates being added within the jib. To allow the crane to be placed in weathervaning mode, the crane operator deactivates the brake of the slewing motor when he leaves his operating cab.

Such systems are described, for example, in patent documents FR 2135689 and EP1422188.

Nevertheless, when the tower crane is installed in a disturbed environment as far as the wind conditions are concerned, the speed and force of the wind which strikes the counterjib can be very different from the speed and force of the wind which simultaneously strikes the jib. The difference between the rotational torque applied to the jib and the rotational torque applied to the counterjib then becomes much greater than the frictional torque of the slewing ring bearing, with the result that the rotating part of the crane, instead of being placed in the direction of the wind, will start to rotate in a certain direction without stopping. Thus, the crane does not manage to weathervane correctly, and its rotating part is driven with an uncontrolled rotation. Under such conditions, there is a risk that the crane might topple over, particularly if a gust of wind strikes the rotating part when said part is oriented perpendicularly to the direction of the wind.

Such disturbed conditions may particularly arise if the crane is installed in an urban site in which neighboring tall buildings exert an influence, or in natural sites such as close to a cliff or in an enclosed valley, or else close to cooling towers of power stations, and other similar situations.

In order to prevent the rotating part of a tower crane from rotating uncontrollably when it is installed on such a site subject to disturbed winds, and hence to avoid the risk of the crane toppling over, a solution has already been proposed which involves interposing, in the slewing mechanism, an additional brake which, when the crane is placed in weathervaning mode, exerts a permanent braking torque that is sufficient to prevent uncontrolled rotation of the rotating part while leaving weathervaning possible. This solution has been described in French patent application 07.05817 of Aug. 10, 2007, published under number FR 2 919 853, and in corresponding European patent application 08356064.9 of Apr. 24, 2008, published under number EP 2025637, in the name of the Applicant.

According to these documents, the proposed solution consists, in the case of a slewing mechanism comprising at least two geared motor units, in providing a geared motor unit having a main brake used for the normal operation of the crane, and another geared motor unit which is equipped with the additional brake intended to brake the rotating part when the crane is out of service, in order to ensure correct weathervaning.

This solution has the disadvantage of being specific to one construction site and to one crane and, since it demands modifications to a crane resulting from mass production, it makes it necessary for the crane to be brought into compliance after work on a construction site has finished. Moreover, this solution is not suited to the case of a slewing mechanism having a single geared reduction unit, unless there is added to the output of the geared reduction unit an external additional brake which, for its part, requires a significant conversion of the crane.

BRIEF SUMMARY OF THE INVENTION

The present invention aims to eliminate these disadvantages, therefore to provide an alternative solution to the problem of the uncontrolled rotation of the rotating part of the crane in the event of disturbed wind, which solution does not require any modification to a mass-produced crane and which can be easily transposed from one construction site to another, and which, moreover, constitutes an appropriate solution for cranes in which the slewing mechanism has only one geared motor unit.

Accordingly, the subject of the present invention is a mechanism for slewing the rotating part of a tower crane, with a device for placing the tower crane in weathervaning mode, the mechanism comprising at least one slewing geared reduction unit with a motor and reduction gear, and with an internal main brake which is deactivated when the crane is placed out of service, and also additional braking means which can be activated when the crane is placed out of service in order to exert on the rotating part of the crane a braking torque which avoids uncontrolled rotation of said rotating part when placed in weathervaning mode, this slewing mechanism being essentially characterized in that the additional braking means are incorporated in the geared motor unit or in one of the geared motor units in the form of an internal auxiliary brake interposed between the motor and the reduction gear.

In a preferred embodiment of the invention, the internal auxiliary brake, interposed between the motor and the reduction gear, is a single disk brake controlled by an electromagnet, this brake being supplied electrically so as not to brake the rotation of the rotating part of the crane when the crane is in service, but exerting a braking torque by way of spring means when it is not supplied electrically, thereby avoiding uncontrolled rotation of the rotating part of the crane when it is placed in weathervaning mode.

Thus, the solution of the invention consists of the addition, within the single geared motor unit or within one of the geared motor units of the slewing mechanism, of an optionally demountable electromechanical assembly composed of a brake, of its electrical box and of its bundle of cables, the device being able to brake an internal shaft of the geared motor unit, and hence to brake the rotating part of the tower crane, while being operational when the crane is placed in weathervaning mode. Conversely, this auxiliary brake must not brake the rotation of the rotating part when the crane is in service, only the main brake coming into play during the operation of the crane. The choice of a single disk brake having electromagnetic control here constitutes a particularly advantageous solution in terms of structural simplicity, space requirement and control.

Advantageously, the auxiliary brake is designed to exert an adjustable braking torque. In particular, if the brake is a disk brake controlled by an electromagnet and urged in the direction of braking by spring means, these means preferably take the form of compression springs acting axially on an armature disk, the compression of the springs or of certain springs being adjustable by screwing an adjusting ring. Thus, the solution of the present invention can be easily transposed from one construction site to another construction site in which there is also a risk of uncontrolled rotation of the rotating part of the crane, since it allows a straightforward adjustment of the braking torque exerted on this rotating part when the crane is out of service. The device of the invention even allows a use on a construction site where there is no disturbed wind, or without demounting the auxiliary brake, if the braking torque of the auxiliary brake can be adjusted to a zero value, in other words if the springs can be relaxed to such a point that they no longer act on the brake disk.

BRIEF DESCRIPTION OF THE DRAWINGS

The invention will be better understood with the aid of the description which follows, with reference to the appended schematic drawing which, by way of example, represents an embodiment of this device for placing a tower crane in weathervaning mode.

DETAILED DESCRIPTION OF THE INVENTION

Figure 1:
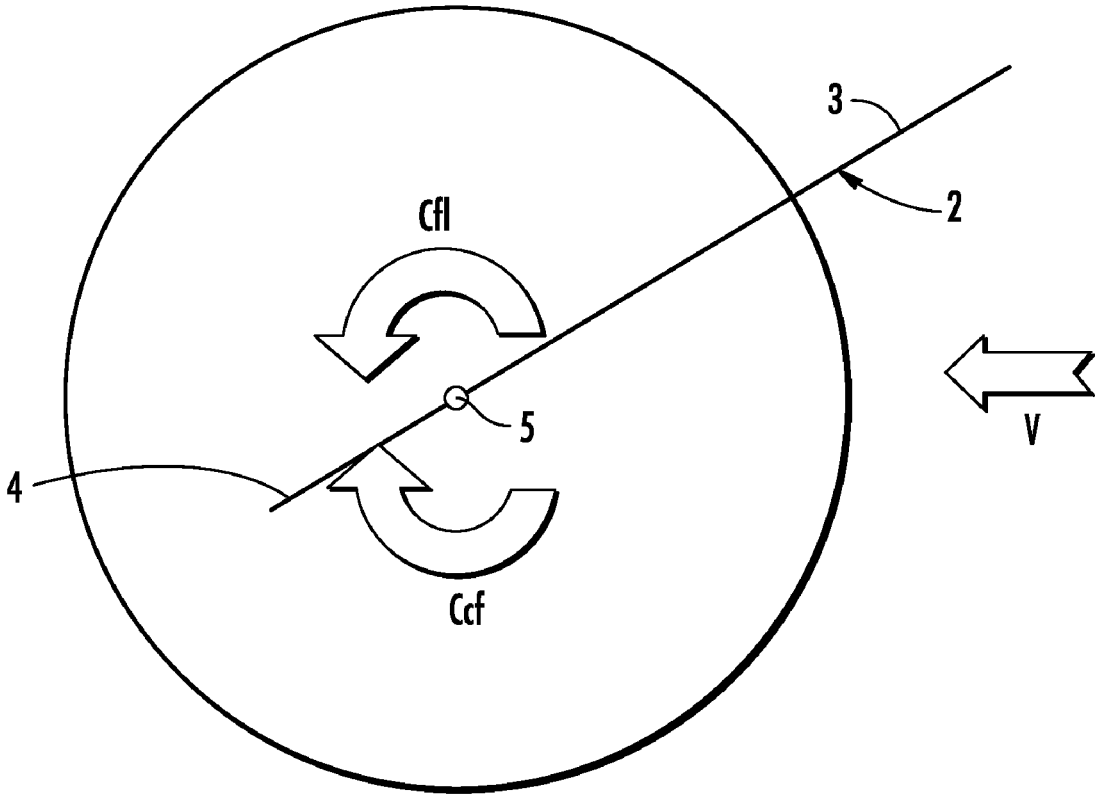
FIG. 1 is a diagram illustrating, in a top plan view, the action of the wind on the rotating part of a tower crane.
Figure 2:
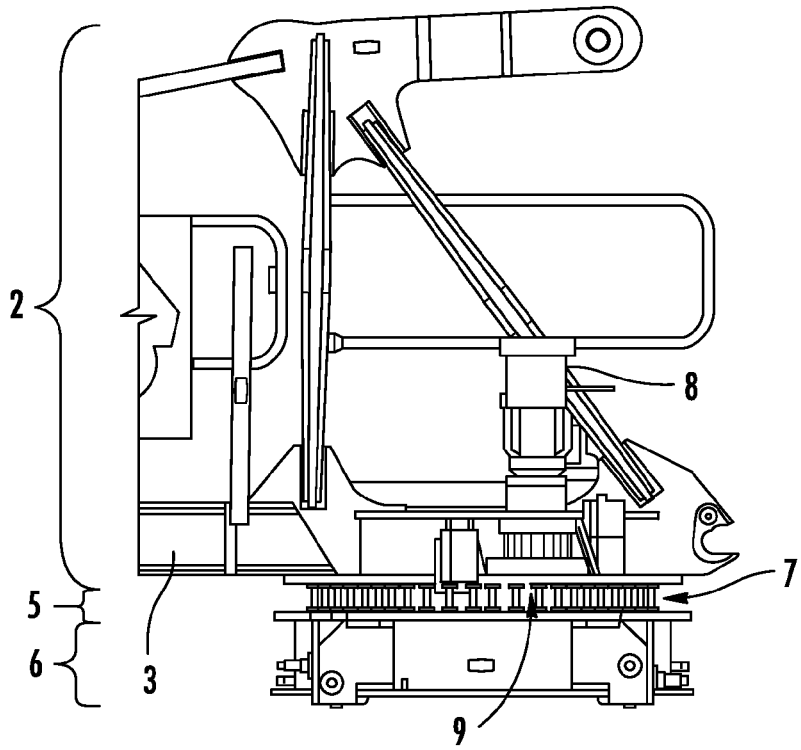
FIG. 2 is a partial side view of the rotating part and in particular of the slewing mechanism of a tower crane, equipped with the device according to the invention.

Referring to FIGS. 1 and 2, the rotating part 2 of a tower crane is composed of a jib 3 and of a counterjib 4, which are aligned on either side of a slewing ring bearing 5 of vertical axis which is mounted on the top 6 of the mast (not shown itself) of the crane. The slewing ring bearing 5 is itself composed of two rings, namely a fixed ring connected to the top 6 of the mast and a movable ring connected to the rotating part 2, the fixed ring externally forming a toothed wheel 7. A geared motor unit 8, which is secured to the rotating part 2, is coupled to a pinion 9, of vertical axis A, which engages with the toothed wheel 7—see also FIG. 3.

Figure 3:
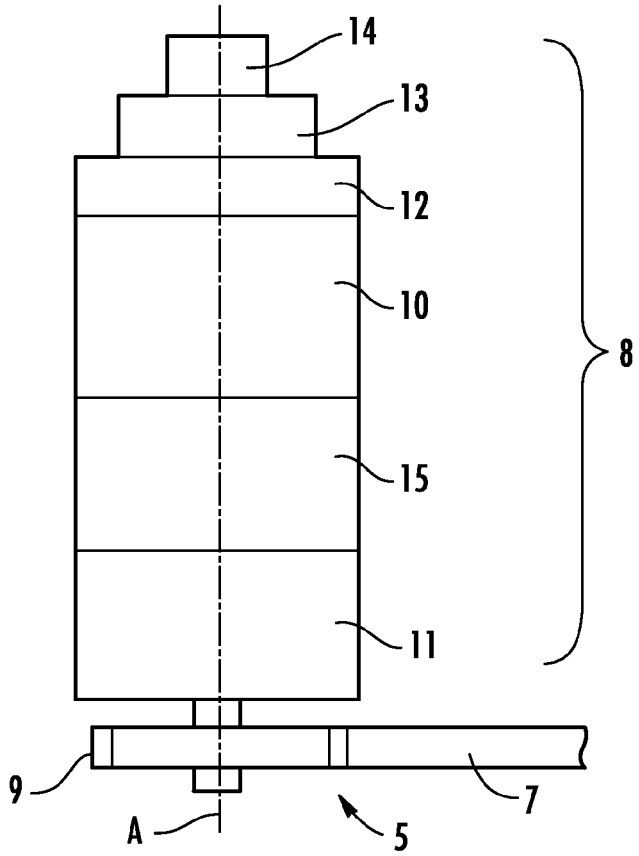
FIG. 3 represents, highly schematically, the device of the invention and in particular the geared motor unit equipped with the auxiliary brake.

In a known manner, as shown in FIG. 3, the geared motor unit 8 comprises an electric motor 10, a reduction gearset 11 and an internal main brake 12, here placed above the motor 10. Provided above the main brake 12 is a weathervaning device 13, itself surmounted by an encoder 14. The weathervaning device 13 makes it possible to mechanically lock the main brake 12 in a nonbraked position when the crane is out of service so that the rotating part 2 can be oriented in the direction of the wind. When the crane is in service, the main brake 12 is automatically actuated while the motor 10 is not supplied with power, and it thus constitutes a service brake.

According to the invention, an auxiliary brake 15 is interposed between the output of the electric motor 10 and the input of the reduction gear 11, inside the geared motor unit 8. The auxiliary brake 15 springs into action only when the crane is placed out of service, in order to exert a braking torque on the rotating part 2 and thus avoid uncontrolled weathervaning in the event of a disturbed wind. In practice, the crane operator, at the end of his working day, places the crane in weathervaning mode by deactivating the main brake 12 of the geared motor unit 8 and by then activating the auxiliary brake 15 so that it can exert its braking torque.

Referring once again to FIG. 1, a wind having a certain speed and direction, indicated by the arrow V, exerts on the rotating part 2 of the crane in question two oppositely directed torques, namely:

a torque Cfl applied by the wind to the jib 3, and a torque Ccf applied by the wind to the counterjib 4.

In addition, a frictional torque Ccou must be taken into consideration at the slewing ring bearing 5 of the rotating part 2.

The main brake 12 must accommodate the difference in torque between the jib 3 and the counterjib 4, while taking account of the frictional torque, up to a maximum wind speed V1 defined by the relevant standards, for example a speed of 72 km/h. Thus, the braking torque $Cfr_1$ for such a wind speed V1 that has to be exerted by this brake 12 must satisfy the following relationship:

$$Cfr_1 > Cfl_1 - Ccf_1 - Ccou$$

where $Cfl_1$ and $Ccf_1$ represent the torques applied by a wind speed V1 to the jib 3 and to the counterjib 4, respectively.

The braking torque, designated $Cfr_2$, exerted by the auxiliary brake 15 in order to avoid uncontrolled rotation of the rotating part 2 of the crane in a disturbed wind is given by the following formula:

$$Cfr_2 = Cfl_2 - Ccf_2 - Ccou$$

where:

$Cfl_2$ represents the torque applied to the jib 3 by a wind having a certain speed V2 which is less than the maximum speed V1, $Ccf_2$ represents the torque applied to the counterjib 4 by the same wind of speed V2 which is less than the maximum speed V1, Ccou represents, as above, the frictional torque of the ring bearing 5.

The wind speed V2 is, for example, equal to 55 km/h (whereas, in the case taken here for example, the speed V1 is equal to 72 km/h).

In order to obtain the braking torque $Cfr_2$ which complies with the above-indicated relationship, all that is required is to use an auxiliary brake 15 provided with one or more springs whose relaxation force gives the desired torque value.

Figure 4:
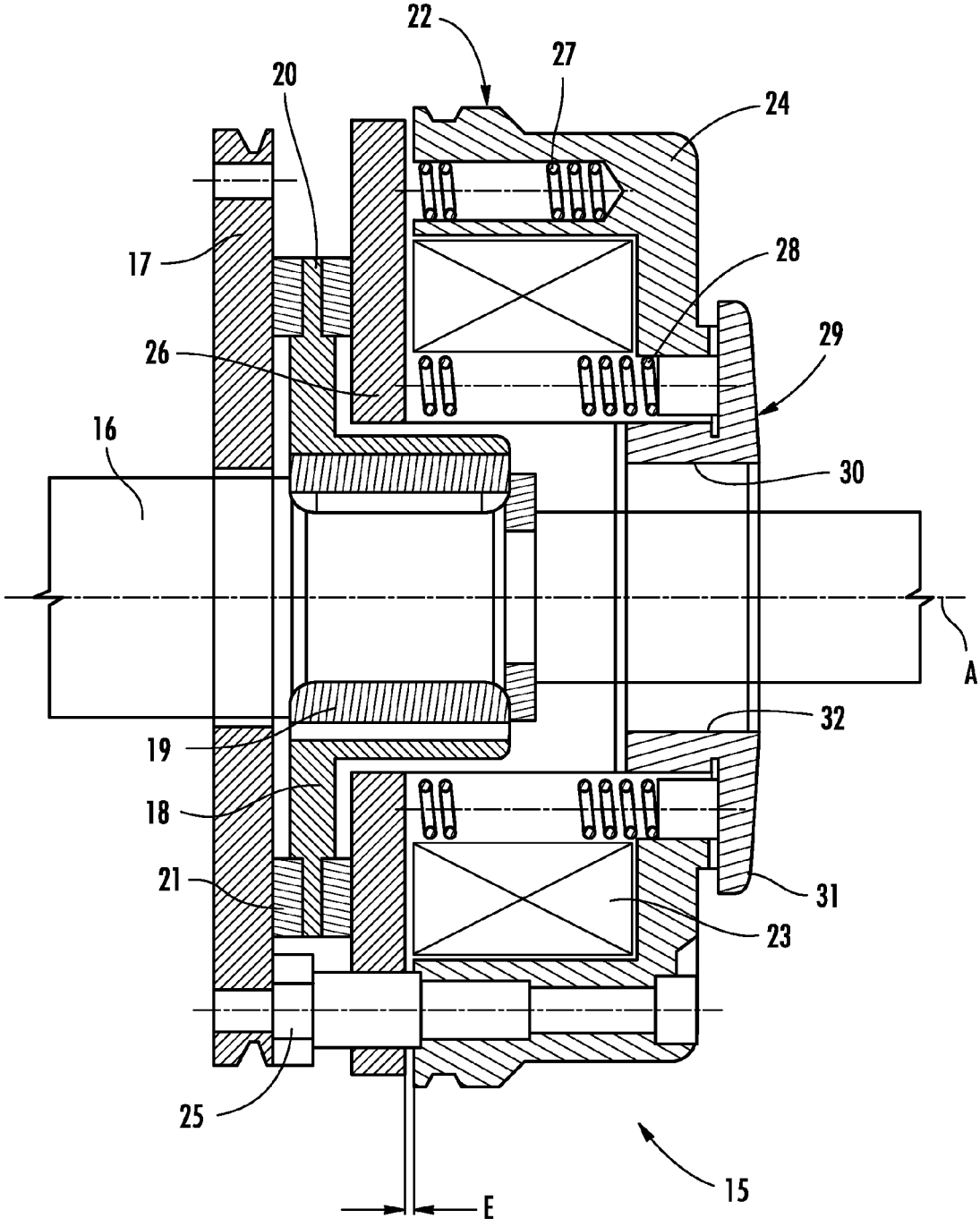
FIG. 4 is a detailed view, in section, of this brake in a particular embodiment.

FIG. 4 illustrates the structure of the internal auxiliary brake in more detail, and makes it possible to understand the operation thereof, in the case of a particular embodiment in which this brake 15 is a single disk brake having electromagnet control.

In FIG. 4, the reference 16 designates a shaft which is internal to the geared motor unit 8 and which constitutes both the output shaft of the motor (not shown—situated on the right) and the input shaft of the reduction gear (not shown—situated on the left). The shaft 16 passes freely through a flange 17 and it carries a rotor 18 composed of a central hub 19, which is keyed to this shaft 16, and of an annular disk 20 provided at its periphery with linings 21 on both surfaces thereof.

On its side facing the motor, the auxiliary brake 15 includes, coaxially to the shaft 16, an electromagnet 22 comprising a coil 23 and a fixed inductor body 24, which is assembled by means of hollow screws 25 to the flange 17. A nonrotating armature disk 26 is mounted between the inductor body 24 and the disk 20, around the hub 19, the hollow screws 25 passing freely through the armature disk 26.

Springs 27 and 28 are housed in bores in the inductor body 24. The springs 27, which have an "outboard" arrangement, are helical compression springs housed in blind bores and pressed, by one end, against one surface of the armature disk 26. The other springs 28, which have an "inboard" arrangement, are helical compression springs housed in throughbores and pressed, by one end, against the same surface of the armature disk 26 as the previous springs 27.

An adjusting ring 29, situated on the motor side, has a threaded hub 30 screwed into the central opening in the inductor body 24, and a collar 31 which, by way of small pistons 32, presses against the ends (the ones facing away from the disk 26) of the springs 28.

The hollow screws 25 make it possible to adjust the air gap E which, in the braked position, separates the armature disk 26 from the inductor body 24 so that the coil 23 can correctly attract this disk 26 and release the brake 15. The adjusting ring 29 makes it possible to set the braking torque to the desired value. By screwing this adjusting ring 29 into the inductor body 24, the length of the "inboard" springs 28 is reduced, the springs 28 being compressed more. Consequently, these springs 28 apply a greater force to the armature disk 26, which itself transmits this force to the disk 20 of the rotor 18, with the result that the braking torque is increased.

When the crane is placed in weathervaning mode, the coil 23 of the electromagnet 22 is not energized, with the result that the armature disk 26 is no longer magnetically attracted toward the inductor body 24. The springs 27 and 28 axially push away the armature disk 26 in the direction of the disk 20 of the rotor 18, thereby braking the shaft 16. Any rotational movement of the rotating part 2 of the crane tends to be transmitted, via the toothed wheel 7 and the reduction gear 11, to the shaft 16, but the latter is braked by the auxiliary brake 15. When the crane is in service, the electromagnet 22 of this brake 15 is activated and it attracts the armature disk 26 while compressing the springs 27 and 28, thus releasing the disk 20 of the rotor 18. The slewing torque produced by the motor 10 then "traverses" the brake 15, via the shaft 16, to be transmitted to the reduction gear 11.

Adjusting the auxiliary brake 15, which is carried out by screwing or unscrewing the adjusting ring 29 to a greater or lesser degree, makes it possible to cover a wide range of braking torques, for example between 4 N.m and 40 N.m. According to one advantageous possibility, the braking torque of the auxiliary brake 15 can be cancelled, thus making it possible to use the device on a construction site where there is no risk of disturbed wind. The braking torque can also be adjusted, in part, by modifying the number of springs acting on the armature disk 26.

The scope of the invention, as defined in the appended claims, would not be departed from:

by replacing the internal auxiliary disk brake having electromagnetic control with a brake of some other type, likewise capable of exerting a braking torque on the rotating part placed in weathervaning mode;

by applying the invention to a tower crane slewing mechanism having any number of geared motor units, in which case the auxiliary brake equips either only one of the geared motor units or a plurality of these geared motor units.

The invention claimed is:

1. A mechanism for slewing a rotating part of a tower crane, with a device for placing the tower crane in weathervaning mode, the mechanism comprising:

at least one slewing geared motor unit with a motor and reduction gear, and with an internal main brake which is deactivated when the crane is placed out of service, and also additional braking means which can be activated when the crane is placed out of service in order to exert on the rotating part of the crane a braking torque which avoids uncontrolled rotation of said rotating part when placed in weathervaning mode, wherein the additional braking means are incorporated in the geared motor unit or in one of the geared motor units in the form of an internal auxiliary brake interposed between the motor and the reduction gear;

wherein the internal auxiliary brake, interposed between the motor and the reduction gear, is a single disk brake controlled by an electromagnet, this brake being supplied electrically so as not to brake the rotation of the rotating part of the crane when the crane is in service, but exerting a braking torque by way of a spring means when it is not supplied electrically, thereby avoiding uncontrolled rotation of the rotating part of the crane when it is placed in weathervaning mode;

wherein, with the auxiliary brake being a brake controlled by the electromagnet and urged in a direction of braking by spring means, these means take the form of compression springs acting axially on an armature disk, the compression of the springs adjustable by screwing an adjusting ring.

2. The slewing mechanism as claimed in claim 1, wherein the auxiliary brake is designed to exert an adjustable braking torque.

3. The slewing mechanism as claimed in claim 2, wherein the braking torque of the auxiliary brake can be canceled.

* * * * *